US006840841B2

(12) United States Patent
Hakomori

(10) Patent No.: US 6,840,841 B2
(45) Date of Patent: Jan. 11, 2005

(54) WAFER EDGE POLISHING SYSTEM

(75) Inventor: Shunji Hakomori, Tokyo (JP)

(73) Assignee: Speedfam Co., Ltd., Ayase (JP)

( * ) Notice: Subject to any disclaimer, the term of this patent is extended or adjusted under 35 U.S.C. 154(b) by 68 days.

(21) Appl. No.: 10/340,668

(22) Filed: Jan. 13, 2003

(65) Prior Publication Data

US 2003/0134570 A1 Jul. 17, 2003

(30) Foreign Application Priority Data

Jan. 15, 2002 (JP) ..... 2002-005536

(51) Int. Cl.[7] ..... B24B 49/00; B24B 51/00
(52) U.S. Cl. ..... 451/5; 451/8; 451/67
(58) Field of Search ..... 451/5, 8, 36, 41, 451/44, 65, 66, 67, 339

(56) References Cited

U.S. PATENT DOCUMENTS 5,679,060 A * 10/1997 Leonard et al. ..... 451/43
6,165,050 A * 12/2000 Ban et al. ..... 451/8
6,227,946 B1 * 5/2001 Gonzalez-Martin et al. .. 451/54
6,244,931 B1 * 6/2001 Pinson et al. ..... 451/8
6,413,145 B1 * 7/2002 Pinson et al. ..... 451/5

FOREIGN PATENT DOCUMENTS

| | | |
|---|---|---|
| JP | 06-047655 | 2/1994 |
| JP | 06-015957 | 3/1994 |
| JP | 08-019946 | 1/1996 |
| JP | 11-198011 | 7/1997 |
| JP | 09-269298 | 10/1997 |
| JP | 11-048109 | 2/1999 |
| JP | 11-090802 | 4/1999 |
| JP | 11-090803 | 4/1999 |
| JP | 11-221745 | 8/1999 |
| JP | 11-351850 | 12/1999 |
| JP | 2000-042885 | 2/2000 |
| JP | 2002-144201 | 5/2002 |

* cited by examiner

*Primary Examiner*—Timothy V. Eley
(74) *Attorney, Agent, or Firm*—Morrison & Foerster LLP

(57) ABSTRACT

Disclosed is a wafer edge polishing system which improves the throughput and reduces the average processing cost. The system incorporates a wafer inspection unit. A wafer is polished in a wafer edge polishing unit and carried by a carrier unit to the wafer inspection unit where the polished surfaces of the wafer is inspected, and if it is judged as poorly polished, it is re-carried to the wafer edge polishing unit by the carrier unit.

3 Claims, 4 Drawing Sheets

WAFER EDGE POLISHING SYSTEM

BACKGROUND OF THE INVENTION

1. Field of the Invention

The present invention relates to a system for mirror-polishing the outer peripheral part of a semiconductor wafer and more particularly to a wafer polishing system for singly mirror-polishing, cleaning and drying the circumferential bevel surfaces and circumferential end surface of a semiconductor wafer, and the notch bevel surfaces (or orientation flat bevel surfaces) and notch end surface (or orientation flat end surface) provided in a notch part (or orientation flat) thereof.

In a semiconductor wafer, a cutaway for positioning, that is, a notch (hereinafter an explanation will be given taking a notch as an example) is formed, and then, bevel surfaces are formed by cutting off the square part of the edge over the outer peripheral part, that is, the overall contour, of the semiconductor wafer including a notch part. FIG. 1A is a plan view of a semiconductor wafer. FIG. 1B is a partial cross-sectional view of a semiconductor wafer W. FIG. 2 is a perspective view showing the periphery of a notch N in enlarged form. A pattern forming surface Sp, circumferential bevel surfaces Sb, and a circumferential end surface (a cylindrical surface forming the outer periphery) Sc of the semiconductor wafer in this state will cause generation of particles in the later process. These surfaces, including the notch bevel surfaces and notch end surface of the notch N, are mirror-finished by polishing.

In the semiconductor manufacturing process, formation and removal of a resist film are repeatedly done on the pattern forming surface Sp. In forming a resist film, resist is also coated outside the pattern forming surface Sp, namely on the circumferential bevel surfaces Sb and circumferential end surface Sc. If the outside resist film should not be removed or its removal should be incompletely done, particles from the residual resist film might adhere to the pattern surface, resulting in a drop in the semiconductor manufacturing yield. To prevent this, the resist film must be virtually completely removed by polishing, from not only the pattern forming surface but also other surfaces.

2. Description of the Related Art

A conventional wafer edge polishing system used for polishing (called edge-polishing) the circumferential bevel surfaces Sb, circumferential end surface Sc, notch bevel surfaces Sbn and notch end surface Scn as mentioned above, has been designed so that each polishing unit takes a sufficiently long polishing time in order to remove the resist film on every wafer virtually completely. In other words, in order to address an infrequent phenomenon, all wafers are polished for a long time. Therefore, despite improvements in polishing conditions, etc. made so far, it still remains difficult to further improve the average throughput in polishing work.

SUMMARY OF THE INVENTION

An object of the present invention is to solve the above problems to improve the throughput in edge polishing work and reduce the average processing cost.

The above problems can be solved by the following means. According to a first aspect of the present invention, a wafer edge polishing system has a load/unload unit, a wafer aligning unit, a wafer edge polishing unit, a wafer cleaning unit, a wafer drying unit, a wafer inspection unit, a carrier unit, and a control unit, wherein a wafer cassette capable of housing a plurality of wafers can be loaded in the load/unload unit; wherein the aligning unit has an aligning function to position a wafer so that its center comes in a predetermined position and also orient it so that its notch or orientation flat is directed in a predetermined direction; wherein the wafer edge polishing unit consists of one or more subunits and has an edge polishing function to polish the wafer's notch bevel surfaces or orientation flat bevel surfaces, notch end surface or orientation flat end surface, circumferential bevel surfaces, and circumferential end surface; wherein the wafer cleaning unit has a function to remove, with a cleaning liquid, contaminations adhering to the wafer due to the above-mentioned polishing operation; wherein the wafer drying unit has a function to perform drying to remove, from the wafer, cleaning liquid residues which result from cleaning operation in the wafer cleaning unit; wherein the wafer inspection unit has a function to inspect the polished surfaces of the wafer polished by the wafer edge polishing unit; wherein the carrier unit consists of one or more subunits and has the functions of: carrying a wafer from a wafer cassette on the load/unload unit to the wafer aligning unit; carrying it from the wafer aligning unit to the wafer edge polishing unit; carrying it from the wafer edge polishing unit to the wafer cleaning unit; carrying it from the wafer cleaning unit to the wafer drying unit; carrying it from the wafer drying unit to the wafer inspection unit; carrying it from the wafer inspection unit to the original slot in the original cassette; and carrying it from the wafer inspection unit to the wafer aligning unit; and wherein the control unit has a function to control operation of each of the units, and if a wafer is judged as poorly polished as a result of inspection in the wafer inspection unit, control the carrier unit so as to re-carry this poorly polished wafer from the wafer inspection unit to the wafer aligning unit.

According to a second aspect of the present invention, the wafer edge polishing system according to the first aspect of the invention further has a re-carrying buffer and the carrier unit further has a function to carry a wafer from the wafer inspection unit to the re-carrying buffer and also a function to carry it from the re-carrying buffer to the wafer aligning unit and the control unit can control the carrier unit so that it once carries the poorly polished wafer from the wafer inspection unit to the re-carrying buffer and places it there, then carries it from this re-carrying buffer to the wafer aligning unit.

According to a third aspect of the present invention, the original slot in the original wafer cassette is used as the re-carrying buffer in the wafer edge polishing system according to the second aspect of the invention.

DETAILED DESCRIPTION OF THE PREFERRED EMBODIMENTS

Figure 1B:
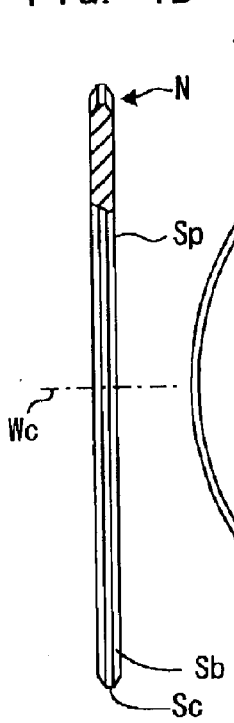
FIG. 1B is a partial cross-sectional view of a semiconductor wafer W.
Figure 1A:
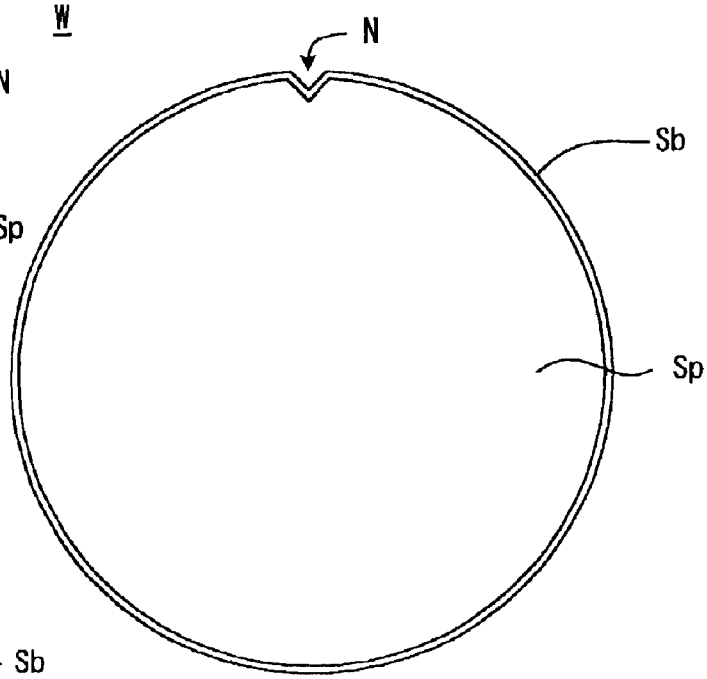
FIG. 1A is a plan view of a semiconductor wafer.
Figure 2:
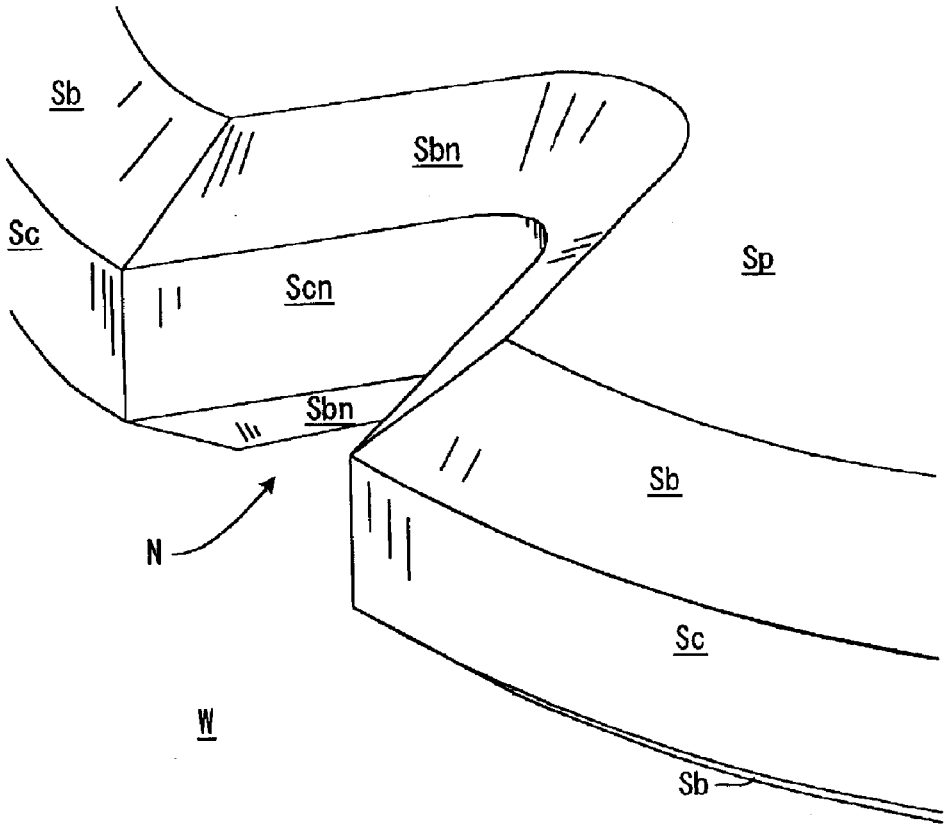
FIG. 2 is a perspective view showing a notch N and its surroundings in enlarged form.
Figure 3:
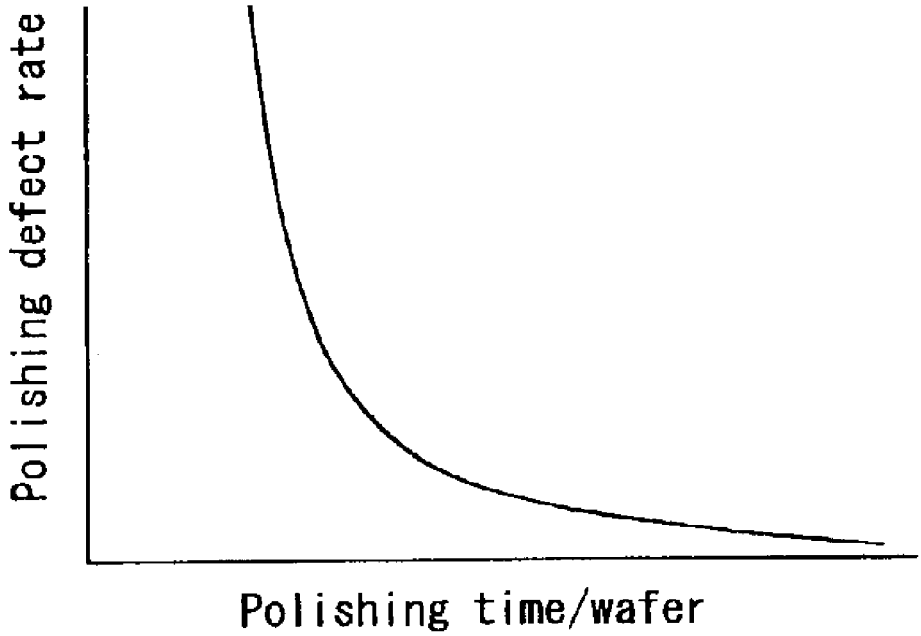
FIG. 3 is a graph qualitatively showing the relation between preset polishing time per wafer and polishing defect rate.
Figure 4:
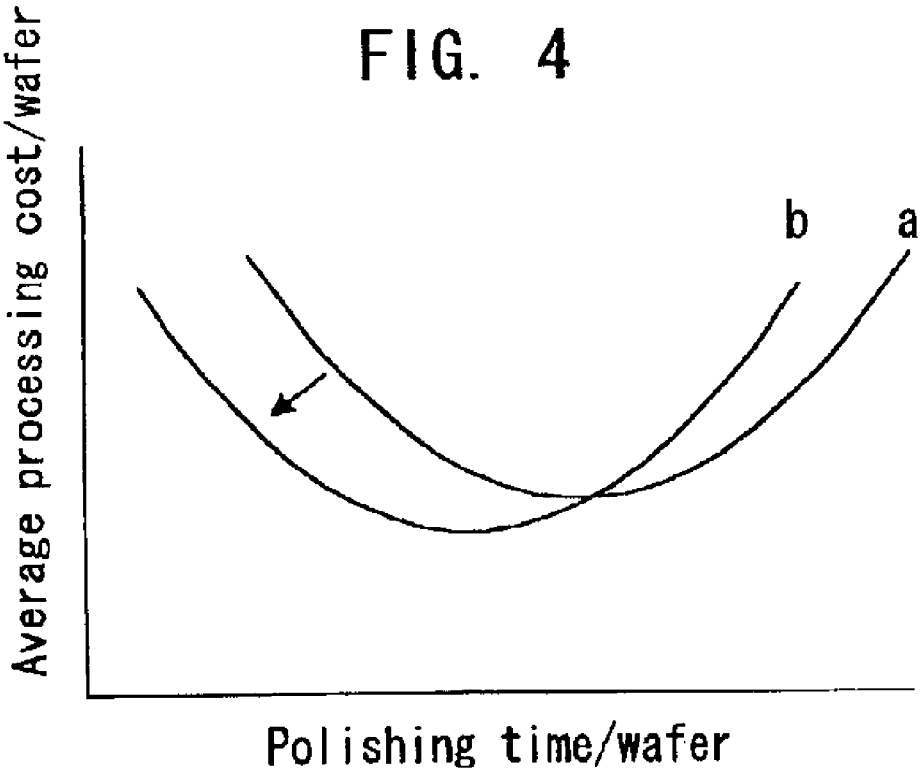
FIG. 4 is a graph qualitatively showing the relation between polishing time and average processing cost.

FIG. 3 is a graph qualitatively showing the relation between preset polishing time per wafer and polishing defect rate. As can be understood from the graph, the longer the preset polishing time is, the lower the polishing defect rate is. When a longer polishing time is set to decrease the polishing defect rate, the total polishing time is longer and thus the average processing cost to obtain an acceptable wafer is higher. On the other hand, when a shorter polishing time is set, the polishing defect rate is higher and the yield rate is lower; thus the average processing cost also increases. In FIG. 4, curve a qualitatively shows the relation between polishing time and average processing cost in the above-said conventional method. Conventionally, an empirically optimal polishing time has been set in order to minimize the average processing cost. This approach assumes that the same polishing time is set for all wafers, namely that a wafer is passed through a polishing apparatus only once. In other words, a long polishing time is set for all wafers in order to address a phenomenon which rarely occurs. Therefore, despite improvements in polishing conditions, etc. made so far, it still remains difficult to further improve the average throughput in polishing work and reduce the cost.

According to the present invention, a relatively short polishing time is set without fixing how many times a wafer is passed through a polishing apparatus; if a wafer is not polished adequately, it is polished again or repeatedly until it is adequately polished. As a consequence, the average throughput is improved and the average cost is reduced.

Figure 5:
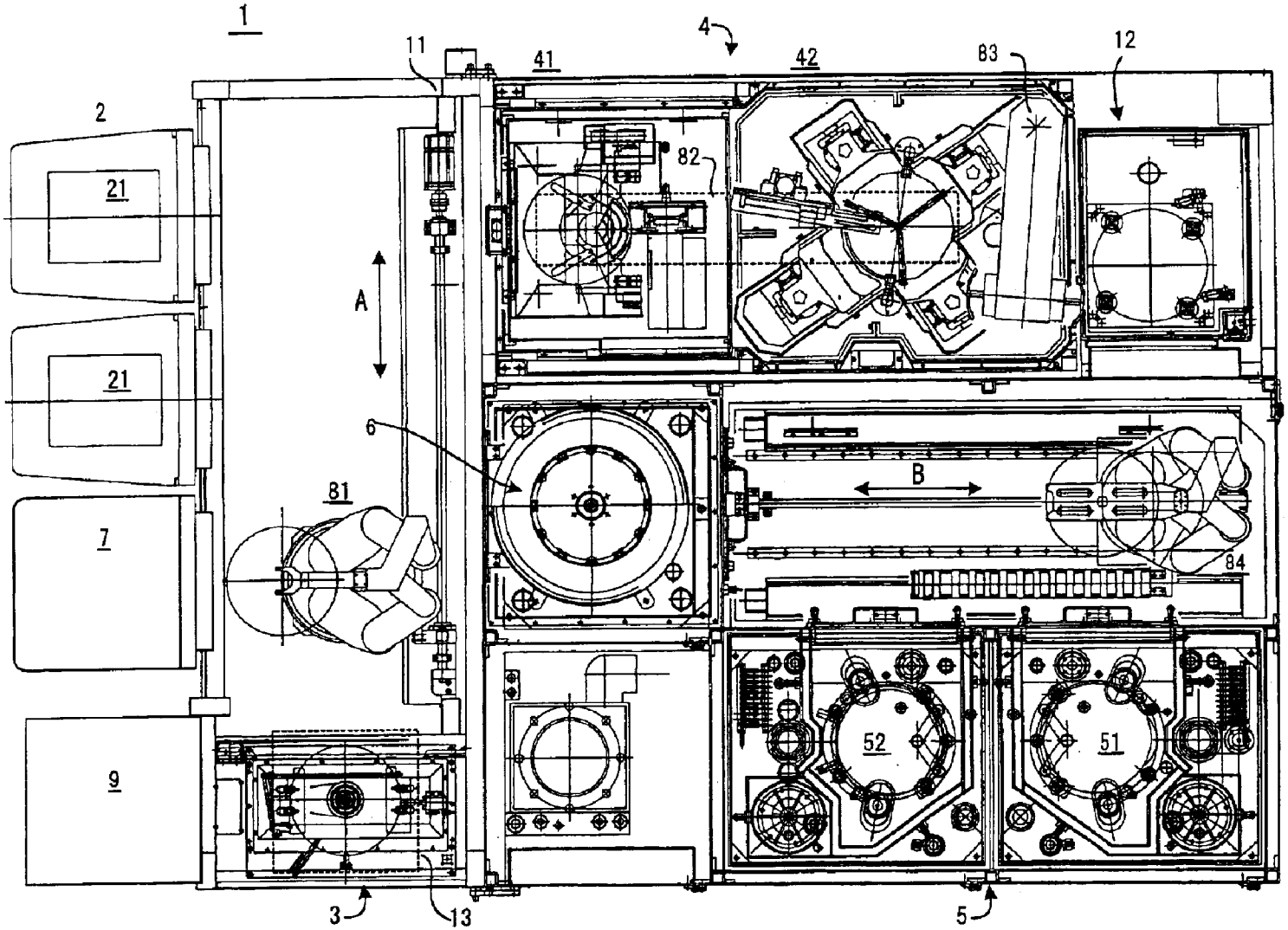
FIG. 5 is a plan view of a wafer edge polishing system according to one embodiment of the present invention.

FIG. 5 is a plan view of a wafer edge polishing system according to one embodiment of the present invention. As shown in the figure, a wafer edge polishing system 1 comprises: a load/unload unit 2, a wafer aligning unit 3, a wafer edge polishing unit 4, a wafer cleaning unit 5, a wafer drying unit 6, a wafer inspection unit 7, a carrier unit 8, and a control unit 9. In addition to these units, the wafer edge polishing system 1 further comprises an intermediate buffer unit 12, a conditioning wafer holding unit 13, and a re-carrying buffer. The arrangement of these units is illustrated in FIG. 5 but the re-carrying buffer is not shown here.

The load/unload unit 2 consists of a trapezoidal table-type unit mounted on the outside of a frame 11 (in this example, two load/unload units are shown); a wafer cassette 21 is placed on it. The wafer cassette has many slots into which wafers are horizontally inserted; the entire wafer cassette 21 is loaded into, or unloaded from, the wafer edge polishing system 1. The wafer cassette 21 is a hermetically sealed box with a detachable cover on one side. When it is placed on the load/unload unit 2, its cover is attachable or detachable by means of a cover opening/closing mechanism (not shown) provided inside the wafer edge polishing system 1. When the cover is detached, a wafer can be put in or out through an opening by the carrier unit 8.

The wafer aligning unit 3 has an aligning function to position a wafer on its work table so as to bring the center of the wafer into a predetermined position and also orient the wafer so as to direct the wafer notch in a predetermined direction. Once the wafer is placed on the table of this unit, it is diametrically sandwiched between a pair of arch-shaped positioning pieces and centered; then it is held down on the table by suction and rotated slowly. After a transmission type photosensor detects a crossing of the notch, the wafer continues rotating by a predetermined angle and stops. The wafer is thus positioned and oriented.

The wafer edge polishing unit 4 consists of, in this example, two subunits: a notch polishing unit 41 and a circumference polishing unit 42. The notch polishing unit 41 is designed to polish the notch bevel surfaces Sbn and notch end surface Scn of a wafer notch; for example, it is a polishing apparatus which places the wafer in horizontal and slanted positions and performs polishing, with slurry dropping, by means of an oscillating polishing tool, as disclosed in Japanese Patent Application No. 183988/2001. The circumference polishing unit 42 is designed to polish the circumferential bevel surfaces Sb and circumferential end surface Sc of the wafer; for example, it is a polishing apparatus which performs polishing, with slurry dropping, by means of a polishing tool having curved surfaces which fit the circumferential bevel surfaces Sb and circumferential end surface Sc, as disclosed in Japanese Patent Application No. 339305/2000.

The wafer cleaning unit 5 consists of a first cleaning unit 51 and a second cleaning unit 52; they are both cleaning apparatuses which clean the wafer by rotating a soft sponge brush and spraying it with a cleaning liquid while the wafer is rotating, as disclosed in Japanese Patent Application No. 353293/2001. The first cleaning unit 51 removes organic contaminations while the second cleaning unit 52 removes inorganic contaminations. The former uses, for example, a solution of ammonia and hydrogen peroxide as a cleaning liquid while the latter uses, for example, a hydrofluoric acid.

The wafer drying unit 6 is a device called a spin dryer, which rotates the wafer held horizontally at high speed to blow cleaning liquid residues off the wafer surface by centrifugal force. Since no centrifugal force is applied to the center of the unit, cleaning liquid residues on the wafer are moved from the center to a place where there exists a centrifugal force, by blowing some type of gas such as nitrogen gas.

The wafer inspection unit 7 is an optical electronic inspection device which checks if a resist film has been virtually completely removed by polishing operation in the wafer edge polishing unit 4. It may be a device as disclosed in Japanese Patent No. 2999712 or Japanese Unexamined Patent Publication No. 351850/1999.

The intermediate buffer unit 12 is located next to the circumference polishing unit 42 and serves as an area on which an edge-polished wafer stained with slurry or other foreign matter temporarily rests. The conditioning wafer holding unit 13 is an area on which a conditioning wafer located above the wafer aligning unit 3 rests. Just after replacement of the polishing tool, very small scratches might be produced because of the surface condition of a new polishing tool. To prevent this, for a while after the replacement, a wafer which is not treated as a product is polished to condition the surface of the new polishing tool. This wafer is called a "conditioning wafer" or "dummy wafer." The conditioning wafer holding unit 13 is a conditioning wafer holder which keeps this type of wafer within the system and picks it up upon tool replacement to do polishing for tool conditioning.

As will be explained later, a wafer which is judged as poorly polished by the wafer inspection unit 7 is repolished. The poorly polished wafer should be sent again to the wafer aligning unit 3 and positioned and oriented. However, if the wafer aligning unit 3 is busy, the wafer must wait until the unit becomes empty. The re-carrying buffer is an area where a waiting wafer is held until the unit becomes empty. The re-carrying buffer may be independently located in any convenient place. In this example, the original slot in the wafer cassette 21 (slot from which the wafer was taken out) or part of the conditioning wafer holding unit 13 is used as a re-carrying buffer.

The carrier unit 8 consists of one or more carrier robots; in this example, it consists of a first carrier unit 81, a second carrier unit 82, a third carrier unit 83, and a fourth carrier unit 84.

The first carrier unit 81 has two hands and two polyarticular arms and can run on a track by means of a carriage which moves in arrow-A directions. This first carrier unit 81 can stop in front of the load/unload units 2, wafer aligning unit 3, notch polishing unit 41, wafer drying unit 6 and wafer inspection unit 7. It can carry the wafer: from the wafer cassette 21 on the load/unload unit 2 to the wafer aligning unit 3; from the wafer aligning unit 3 to the wafer edge polishing unit 4 (notch polishing unit 41); from the wafer drying unit 6 to the wafer inspection unit 7; from the wafer inspection unit 7 to the original slot in the original wafer cassette 21; from the wafer inspection unit 7 to the wafer aligning unit 3; from the conditioning wafer holding unit 13 to the wafer aligning unit 3; from the wafer drying unit 6 to the conditioning wafer holding unit 13; from the wafer inspection unit 7 to the re-carrying buffer; and from the re-carrying buffer to the wafer aligning unit 3.

The second carrier unit 82 is located on the ceiling of the frame 11, above the notch polishing unit 41 and circumference polishing unit 42 of the wafer edge polishing unit 4 and can run between the notch polishing unit 41 and circumference polishing unit 42. It has a vertically movable claw-type catch device. This enables the wafer to be conveyed from the notch polishing unit 41 to the circumference polishing unit 42.

The third carrier unit 83 is an oscillating type carrier robot with an arm. It carries the wafer from the circumference polishing unit 42 to the intermediate buffer unit 12.

Like the first carrier unit 81, the fourth carrier unit 84 has two hands and two polyarticular arms and can run on a track by means of a carriage which moves in arrow directions B. It can stop in front of the intermediate buffer unit 12, first cleaning unit 51, second cleaning unit 52 and wafer drying unit 6. It can carry the wafer: from the intermediate buffer unit 12 to the first cleaning unit 51; from the intermediate buffer unit 12 to the second cleaning unit 52; from the first cleaning unit 51 to the second cleaning unit 52; and from the second cleaning unit 52 to the wafer drying unit 6.

Figure 6:
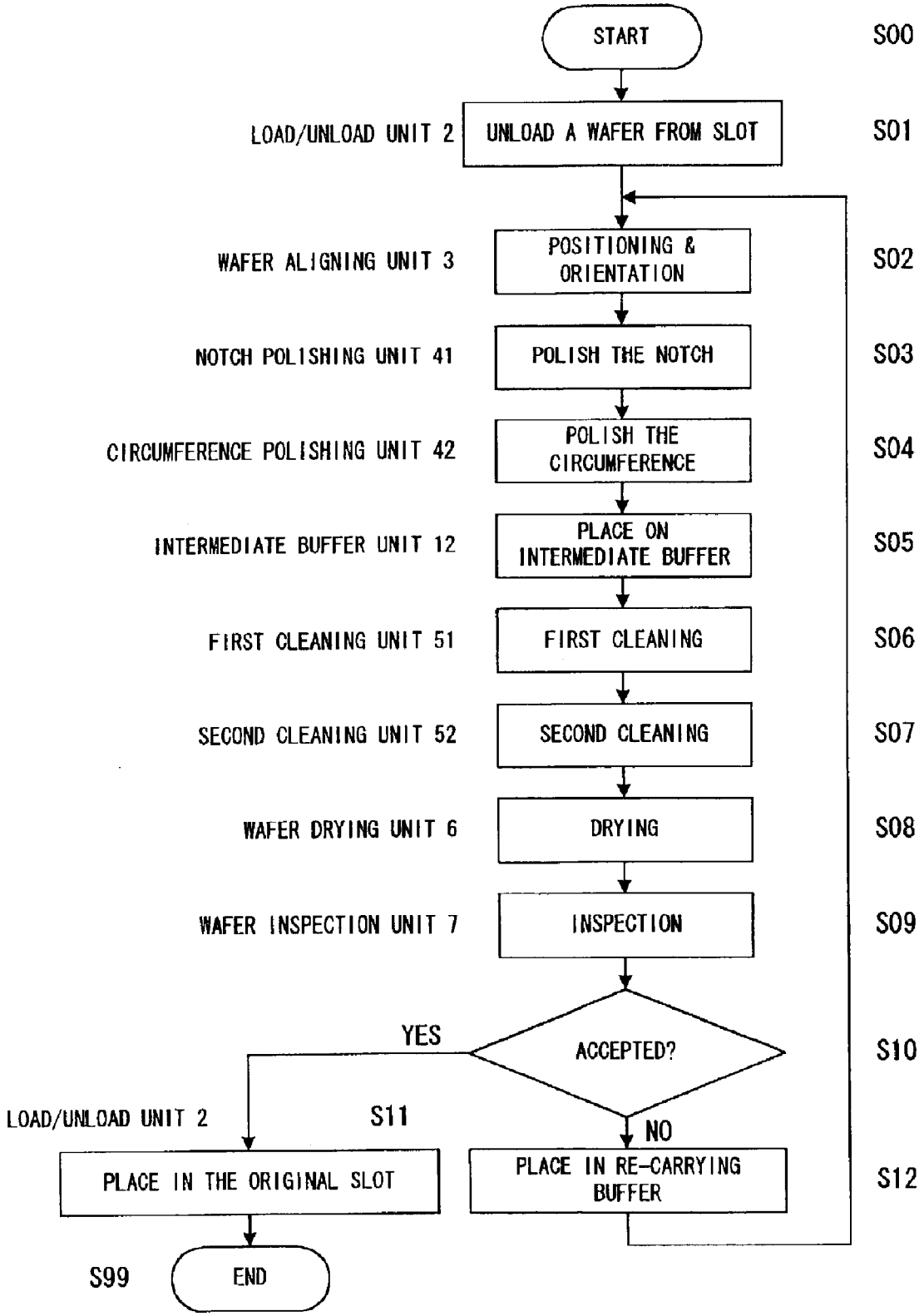
FIG. 6 is a flow chart showing a general control sequence from the viewpoint of wafer transport.

The control unit 9 is illustrated in the figure as a single unit; however, it may be a set of subunits. Also it may be a computer for control which is located remotely and connected via a communication line. It controls operation of the above-mentioned units. FIG. 6 is a flow chart showing a general control sequence for the above-mentioned units from the viewpoint of wafer transfer.

As the wafer cassette 21 is placed in the load/unload unit 2, the sealing cover is taken out from the inside of the apparatus by means of the cover opening/closing mechanism (not shown). The first carrier unit 81 picks up a wafer from a slot through the opening and conveys it to the wafer aligning unit 3 (S01). The wafer aligning unit 3 determines the position and orientation of the wafer placed on the table as mentioned earlier (S02).

The first carrier unit 81 conveys the positioned and oriented wafer to the table of the notch polishing unit 41. The position and orientation of the wafer on the table are thus determined by positioning and orienting operation performed at the wafer aligning unit 3. In the notch polishing unit 41, while the wafer is brought into a horizontal position and a slanted position or its angle is varied step by step, the notch is polished by an oscillating tool with dropping slurry (S03).

The second carrier unit 82 conveys the wafer whose notch has been polished, to the circumference polishing unit 42. In the circumference polishing unit 42, the conveyed wafer is polished by a polishing tool having curved surfaces which fit the circumferential bevel surfaces Sb and the circumferential end face Sc, along with dropping slurry (S04).

The third carrier unit 83 places the wafer whose circumference has been polished, on the intermediate buffer unit 12 (S05). The fourth carrier unit 84 waits until the first cleaning unit 51 becomes empty; then it conveys the wafer on the intermediate buffer unit 12 to the first cleaning unit 51 where organic contaminations are mainly removed from the wafer (S06). Then the fourth carrier unit 84 conveys the wafer to the second cleaning unit 52, located next to it, and inorganic contaminations are removed there (S07).

The cleaned wafer is conveyed by the fourth carrier unit 84 to the wafer drying unit 6 where cleaning liquid residues on the wafer are blown away by the centrifugal force generated during high speed rotation (S08).

The dried wafer is conveyed to the wafer inspection unit 7 by the first carrier unit 81. The wafer inspection unit 7 checks whether the resist film has been virtually completely removed by polishing at the wafer edge polishing unit 4 (S09). Then, the inspection result is checked against a predetermined criterion to decide whether to accept or reject the wafer. If it is accepted (YES), the first carrier unit 81 brings the wafer back to the original slot from which it was taken out (S11).

If it is rejected, namely it has not been adequately polished (NO), the first carrier unit 81 conveys the wafer to the re-carrying buffer (S12). In this case, the original slot in the wafer cassette from which the wafer was taken out or part of the conditioning wafer holding unit 13 is used as the re-carrying buffer. It is needless to say that a special re-carrying buffer may be installed instead.

When the wafer aligning unit 3 becomes empty, the first carrier unit 81 conveys the wafer on the re-carrying buffer (poorly polished wafer) again to the wafer aligning unit 3. If the re-carrying buffer merely serves as a waiting area where the wafer rests until the wafer aligning unit 3 becomes empty, and the wafer aligning unit 3 becomes ready to receive the wafer, then it may be loaded directly on the wafer aligning unit 3 without the need to store it in the re-carrying buffer (i.e. step S12 can be skipped).

This wafer is polished again as explained above. This polishing process is repeated until the wafer is accepted. However, a wafer which is rejected repeatedly may have another type of defect. Such a wafer (identified individually) may be treated in a different way (for example, exclusion from the lot).

When the polishing tool (abrasive cloth) is replaced, at step S01 a conditioning wafer is taken out from the conditioning wafer holding unit 13 instead of a wafer being taken out from the load/unload unit 2, and the conditioning wafer is conveyed to the wafer aligning unit 3. The conditioning wafer need not be inspected by the wafer inspection unit 7 so the first carrier unit 81 brings the conditioning wafer back to the conditioning wafer holding unit 13 or conveys it to the wafer aligning unit 3 again, instead of step S09.

In the above explanation of the wafer edge polishing system, it is assumed that a wafer has a notch for positioning (orientation). If a wafer having a straight-line positioning means called an orientation flat instead of a notch is to be polished, the notch polishing unit 41 in the above system should be replaced by an orientation flat polishing unit which can polish orientation flat bevel surfaces and orientation flat end surfaces.

The re-carrying buffer may also be designed so that, when a fixed number of poorly polished wafers are accumulated there, they are re-polished for a time just enough to compensate for the polishing inadequacy, or for a time shorter than usual. This shortens the tact time for re-polishing in the production process, thereby improving efficiency.

As explained so far, in the wafer edge polishing system 1, the wafer is polished by the wafer edge polishing unit 4 and then conveyed to the wafer inspection unit 7 by the carrier unit 8; in the wafer inspection unit 7, the polished surface of the wafer is inspected, and if it is judged as poorly polished, it is conveyed again to the wafer edge polishing unit 4 by the carrier unit 8. Therefore, it is not necessary to set a polishing time sufficient to remove the resist film virtually completely as in the conventional type of wafer edge polishing system. In other words, in this wafer edge polishing system 1, only poorly polished wafers are re-polished. The graph in FIG. 4 shows the relation between polishing time per wafer and average processing cost. In the graph, curve b representing this system is mostly lower than curve a representing the conventional system. Furthermore, it is possible to perform wafer edge polishing at a lower average processing cost by utilizing trial-and-error and statistic approaches to find the polishing time per wafer which corresponds to the lowest region of curve b.

In the wafer edge polishing system or wafer edge polishing control method according to the present invention, there is no need to set a polishing time long enough to remove the resist film virtually completely as in the conventional type of wafer edge polishing system; instead, re-polishing is done only on poorly polished wafers which are infrequently caused by a short polishing time, and thus the average processing cost per wafer with respect to the polishing time per wafer is mostly lower than in the conventional method. Thus, in wafer edge polishing, the throughput can be improved and the average processing cost can be reduced.

What is claimed is:

1. A wafer edge polishing system comprising:

a load/unload unit for placing a wafer cassette in which a plurality of wafers are inserted;

a wafer aligning unit for aligning a wafer so that a center of the wafer comes in a predetermined position and a notch or orientation flat of the wafer is directed in a predetermined direction;

a wafer edge polishing unit consisting of one or more subunits for polishing circumferential bevel and end surfaces of said wafer and bevel and end surfaces of said notch or said orientation flat by using slurry;

a wafer cleaning unit for cleaning said wafer with cleaning fluid so as to remove slurry adhering to said wafer;

a wafer drying unit for drying said wafer so as to remove said cleaning liquid adhering to said wafer;

a wafer inspection unit for inspecting the surfaces of the wafer polished by said wafer edge polishing unit;

a carrier unit consisting of one or more subunits and a control unit for controlling operation of each of said units;

wherein, said carrier unit carries a wafer from an original slot in an original wafer cassette on said load/unload unit to said wafer aligning unit; from said wafer aligning unit to said wafer edge polishing unit; from said wafer edge polishing unit to said wafer cleaning unit; from said wafer cleaning unit to said wafer drying unit; from said wafer drying unit to said wafer inspection unit; from said wafer inspection unit to the original slot in the original cassette; and from said wafer inspection unit to said wafer aligning unit; and said control unit controls said carrier unit so as to re-carry a wafer from said wafer inspection unit to said wafer aligning unit when said wafer is judged as poorly polished as a result of inspection in said wafer inspection unit.

2. A wafer edge polishing system according to claim 1, wherein:

said system further comprises a re-carrying buffer;

said carrier unit can carry a wafer from said wafer inspection unit to said re-carrying buffer and from said re-carrying buffer to said wafer aligning unit; and said control unit can control said carrier unit so that said carrier unit carries said poorly polished wafer from said wafer inspection unit to said re-carrying buffer, then carries said poorly polished wafer from said re-carrying buffer to said wafer aligning unit.

3. A wafer edge polishing system according to claim 2, wherein a previously used slot of a previously used wafer cassette from which a wafer was removed is used as said re-carrying buffer for the wafer.

* * * * *